US006050670A

United States Patent [19]

Tooyama et al.

[11] Patent Number: 6,050,670

[45] Date of Patent: Apr. 18, 2000

[54] INK-JET PRINTER WITH SWITCH VALVE BETWEEN CAPS FOR PRINTHEADS AND PUMP

[75] Inventors: Sintaro Tooyama; Shinji Isobe; Koichi Tanaka, all of Niigata, Japan

[73] Assignee: NEC Corporation, Japan

[21] Appl. No.: 08/974,743

[22] Filed: Nov. 19, 1997

[30] Foreign Application Priority Data

Nov. 20, 1996 [JP] Japan ..... 8-308563

[51] Int. Cl.[7] ..... B41J 2/165

[52] U.S. Cl. ..... 347/29

[58] Field of Search ..... 347/22, 23, 29, 347/30; 137/565, 572, 574, 575

[56] References Cited

U.S. PATENT DOCUMENTS 5,828,389 10/1998 Yamaguchi et al. ..... 347/23

FOREIGN PATENT DOCUMENTS 0597675 5/1994 European Pat. Off. .
0630754 12/1994 European Pat. Off. .
0736387 10/1996 European Pat. Off. .
63-224957 9/1988 Japan .
6-328700 11/1994 Japan .
8-1960 1/1996 Japan .

OTHER PUBLICATIONS

Patent Abstracts of Japan vol. 095, No. 6, Jul. 31, 1995 & JP 07 068790 A, Mar. 14, 1995.
Patent Abstracts of Japan vol. 095, No. 008, Sep. 29, 1995 & JP 07 137271 A, May 30, 1995.

*Primary Examiner*—N. Le
*Assistant Examiner*—Anh T. N. Vo
*Attorney, Agent, or Firm*—Ostrolenk, Faber, Gerb & Soffen, LLP

[57] ABSTRACT

A switch valve contacts flexible tubes that connect caps for printheads to a pump. The switch valve includes a tube support. The support is formed with grooves receiving intermediate portions of the flexible tubes, which tubes are curved along rounded corner sidewalls that project toward an entrance of the support. A rotary member controls pivotal motion of a lever. The lever pivots in one direction to squeeze one of the tubes against the associated one of the corner sidewalls, and it pivots in the opposite direction to squeeze the other one of the tubes.

15 Claims, 9 Drawing Sheets

FIG. 2
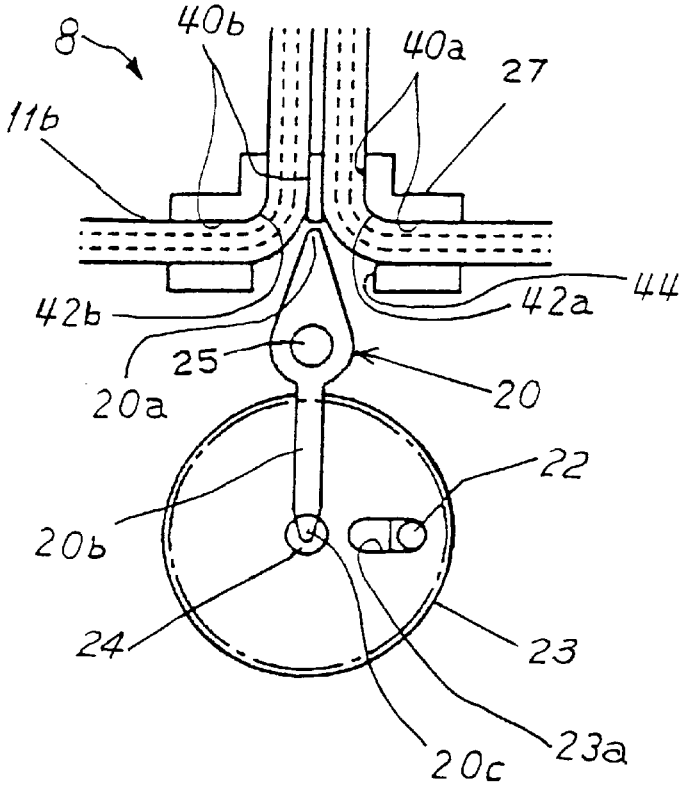
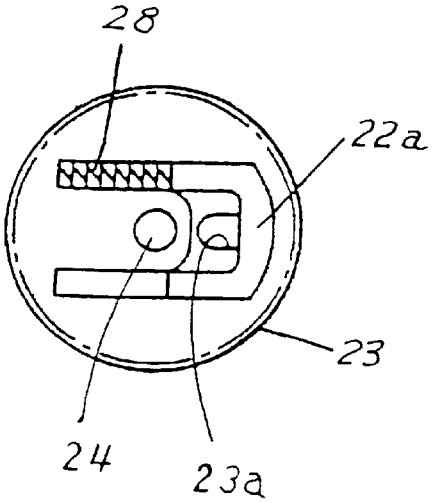
FIG. 3

INK-JET PRINTER WITH SWITCH VALVE BETWEEN CAPS FOR PRINTHEADS AND PUMP

BACKGROUND OF THE INVENTION

1. Field of the Invention

The present invention relates to an ink-jet printer with a service station including a switch valve that selectively connects caps for ink jet printheads to a pump.

2. Description of the Related Art

JP-A 63-224957 discloses an ink-jet printer with a service station. According to this service station, caps define cavities around ink-jet printheads, respectively. Flexible tubes are connected at one end to the caps. At the other end, the tubes are connected to ON/OFF valves. A pump is connected to all of the ON/OFF valves. Each of the ON/OFF valves has a first position in which communication between the associated tube and the pump is established and a second position in which the communication is blocked. A control unit has an authority over these valves so as to open communication between a selected one of the caps and the pump.

JP-A 6-328700 discloses another service station in which a cam is arranged to contact an assembly of flexible tubes. The tubes connect different ink chambers of an ink cartridge to nozzles of ink-jet printhead, respectively. A cap defines a cavity around the ink-jet printhead. A motor driven pump is connected to the cap. In operation, the cam takes one of predetermined angular positions to squeeze all of the other tubes except a selected one tube. The motor is put into operation to drive the pump, initiating discharge of plugged ink from the one nozzle that communicates with the selected one tube. Similarly, the pump discharges plugged ink from all of the other nozzles one after another in timed relation with shifting of the cam to the other predetermined angular positions one after another.

An object of the present invention is to provide a less complicated alternative to the known service station.

SUMMARY OF THE INVENTION

According to the present invention, there is provided a service station for an ink-jet printer including printheads, comprising:

caps for the printheads;

a pump; and a switch valve fluidly disposed between said caps and said pump, said switch valve having a first position in which one fluid communication between one of said caps and said pump only is opened to allow discharge of fluid via said one cap by the pump and a second position in which another fluid communication between other of said caps and said pump only is opened to allow discharge of fluid via said other cap by said pump.

BRIEF DESCRIPTION OF THE DRAWINGS

FIG. 2 is a fragmentary view of the service station, illustrating schematically a front elevation of a switch valve in a first or home position in which both of flexible tubes are left open;

FIG. 3 is a rear elevation of a gear of the switch valve;

DESCRIPTION OF THE EMBODIMENTS

Figure 1:
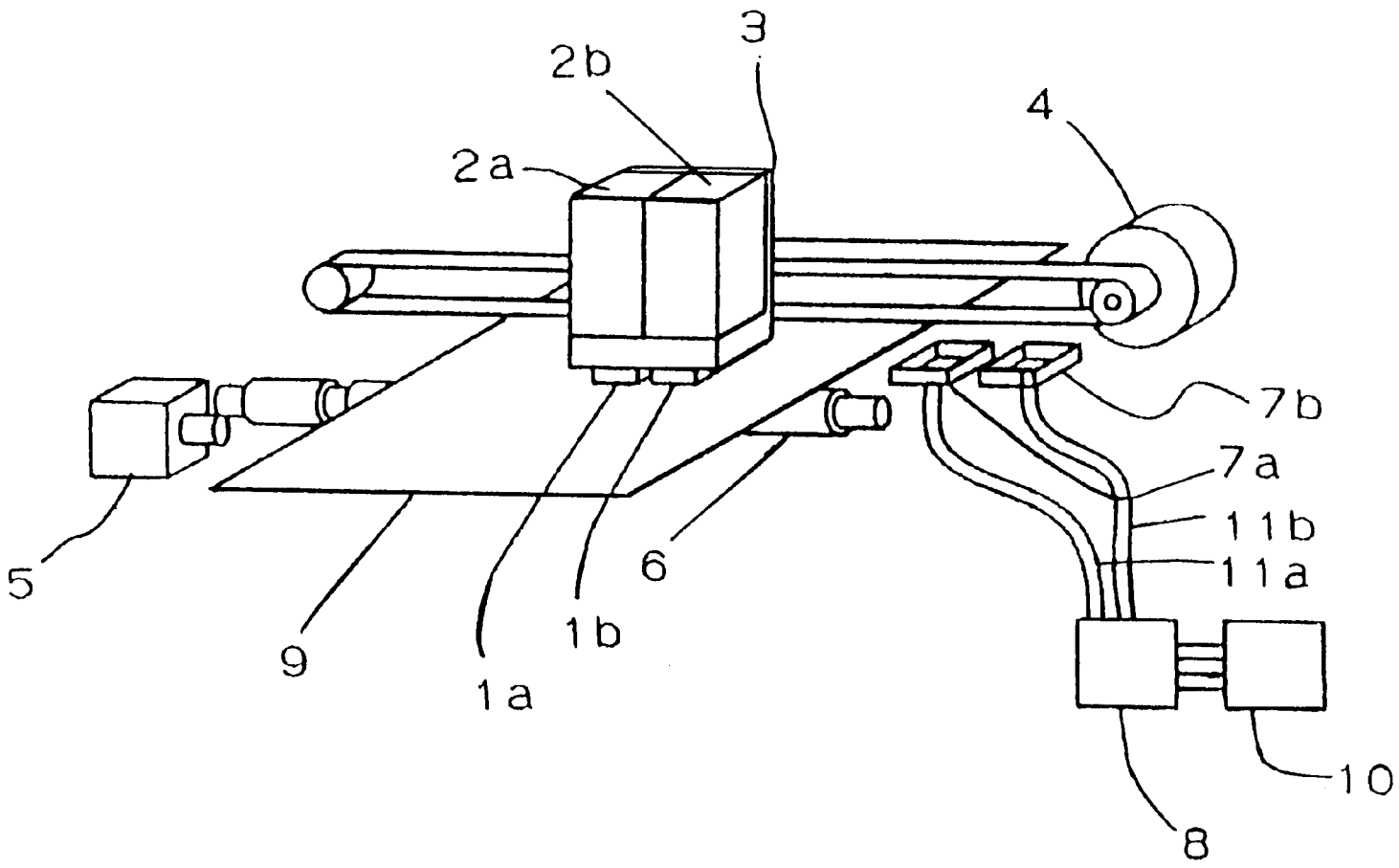
FIG. 1 is a diagrammatic view of a printer with a service station by a block diagram.

Referring to FIG. 1, an ink-jet printer with a service station is illustrated. Reference numerals 1*a* and 1*b* denote a printhead-A and a printhead-B, respectively. The printhead-A 1*a* and printhead-B 1*b* are operatively associated in a known manner with ink tank- A 2*a* and ink tank-B 2*b*, respectively. The printhead-A 1*a* and its operatively associated ink tank-A 2*a*, and printhead-B 1*b* and its associated ink tank 2*b* are mounted on a carriage 3. A carriage motor 4 is provided to move the carriage 3 along the width of a paper sheet 9. A motor 5 is provided to rotate a roller 6 that is arranged to convey the paper sheet 9. A service station for nozzles of the printhead-A 1*a* and printhead-B 1*b* includes a cap-A 7*a*, a cap-B 7*b*, a switch valve 8, a pump 10, a flexible tube-A 11*a*, and a flexible tube-B 11*b*. The flexible tube-A 11*a* connects the associated cap-A 7*a* to the pump 10. The flexible tube-B 11*b* connects the associated cap-B 7*b* to the pump 10. The flexible tube-A 11*a* and flexible tube-B 11*b* form a part of the switch valve 8.

Referring to FIG. 2, the switch valve 8 includes a tube support 27 for the flexible tube-A 11*a* and flexible tube-B 11*b*. The support 27 is formed with two grooves or recesses 40*a* and 40*b*, each having a corner portion, and includes wall means defining the grooves 40*a* and 40*b*. The wall means include a corner sidewall 42*a* that partly defines the corner portion of the groove 40*a* and a corner sidewall 42*b* that partly defines the corner portion of the groove 40*b*. The tube support 27 is recessed inwardly towards the corner sidewalls 42*a* and 42*b* from an entrance 44. The corner sidewalls 42*a* and 42*b* are rounded and protrude towards the entrance 44. At an intermediate portion, the flexible tube-A 11*a* is fit in the groove 40*a* and curved along the rounded corner sidewall 42*a*. Similarly, the flexible tube-B 11*b* is fit into the groove 40*b* and curved along the rounded corner sidewall 42*b*. Viewing in FIG. 2, the flexible tube-A 11*a* and tube-B 11*b* extend upwards from the support 27 for connection with the associated cap-A 7*a* and cap-B 7*b*, respectively. From the support 27, the flexible tube-A 11*a* extends rightwards for connection with the pump 10, while the flexible tube-B 11*b* extends leftwards for connection with the same pump 10. In FIG. 2, an outer wall of each of the flexible tube-A 11*a* and tube-B 11*b* is fully drawn and an inner wall thereof that defines a fluid flow path is drawn by the broken line.

The switch valve 8 also includes a pivotal lever 20. At an intermediate portion, the lever 20 is mounted to a pivot shaft 25 that is provided near the entrance 44 of the support 27. The lever 20 extends through the entrance 44 into the recess and towards one end 20*a* thereof, and it is tapered towards the one end 20*a*. The lever 20 includes an arm 20*b*. The arm 20*b* extends from the intermediate portion to an opposite end 20*c* of the lever 20. The switch valve 8 includes a rotary member in the form of a gear 23. The gear 23 has a shaft 24 with an axis for rotation about this axis. The gear 23 is formed with a radial slot 23*a* through which a pin 22 of a slider 22*a* (see FIG. 3) extends. As shown in FIG. 3, the slider 22*a* is mounted on the rear face of the gear 23 for limited diametrical movement with respect to the axis of the shaft 24 and a spring 28 is provided to bias the slider 22*a* to a position as illustrated. This allows radial movement of the pin 22 along the radial slot 23*a*. In this embodiment, a motor may turn the gear 23.

The first embodiment thus far described operates as follows.

Figure 4:
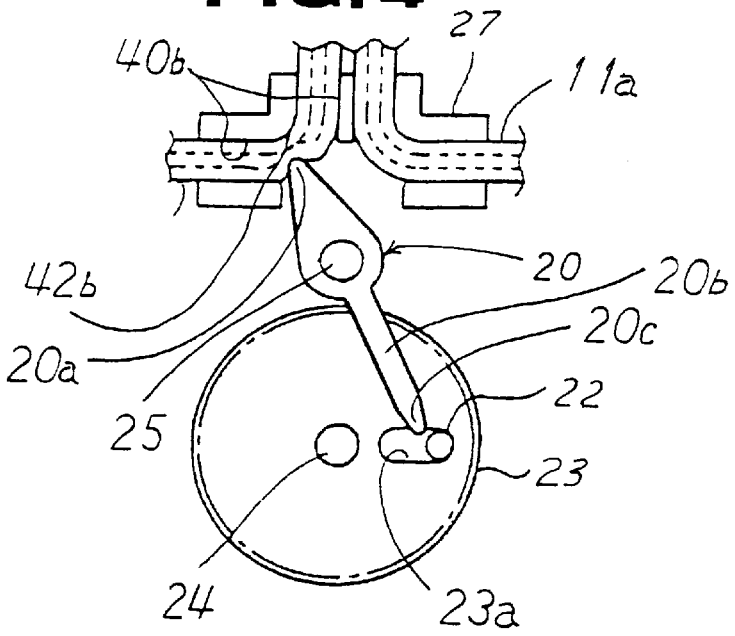
FIG. 4 is a similar view to FIG. 2, illustrating the switch valve held in a second position in which one of flexible tubes is squeezed and closed.
Figure 5:
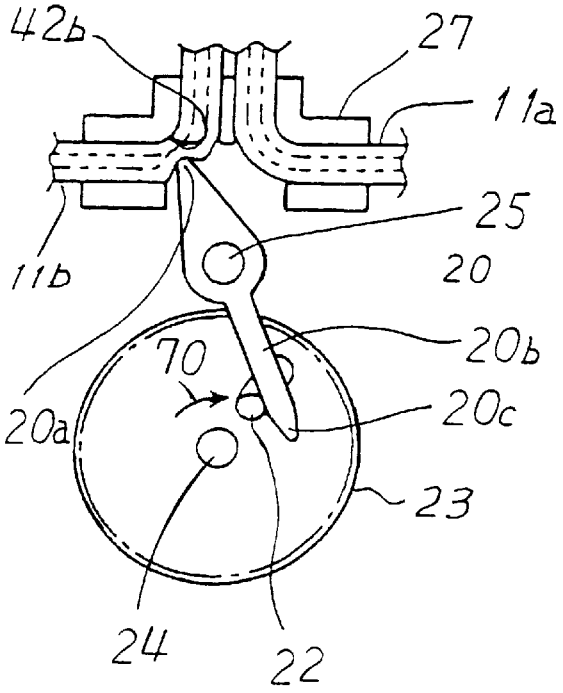
FIG. 5 is a similar view to FIG. 2, illustrating the switch valve in a transient state into the second position shown in FIG. 4.

FIG. 2 illustrates a first or home position of the switch valve 8 in which the lever 20 positions diametrically with respect to the axis of the gear shaft 24. Viewing in FIGS. 2, 5 and 4, turning the gear 23 clockwise from the home position (see FIG. 2) through approximately 270 degrees brings the pin 22 into abutting engagement with the left side of the arm 20*b*. Further clockwise rotation of the gear 23 causes the pin 22 to act on the arm 20*b* to pivot the lever 20 counterclockwise to the position of FIG. 4 and FIG. 5. During this counterclockwise movement of the lever 20, the tapered end 20*a* presses the tube-B 11*b* towards the corner sidewall 42*b*. As the lever 20 stops its counterclockwise movement, clockwise rotation of the gear 23 causes the arm 20*b* to move the pin 22 against the action of the spring 28 for radial inward movement to the radial innermost position as shown in FIG. 5. The pin 22 moves along the radial slot 23*a* to clear the end 20*c* of the arm 20*b*, thus allowing smooth rotation of the gear 23 from the position of FIG. 5 to the position of FIG. 4. In the position of FIG. 4, the tapered one end 20*a* cooperates with the corner sidewall 42*b* to squeeze the tube-B 11*b* and the pin 22 takes the radial outermost position again. Owing to the resiliency of the tube-B 11*b* that is interposed between the tapered one end 20*a* and the corner sidewall 42*b*, the lever 20 keeps on taking the position of FIG. 4. After the switch valve 8 having taken the position of FIG. 4, the pump 10 is put into operation to start drawing fluid. As the tube-B 11*b* is squeezed, the portion of the tube-B 11*b* that is disposed between the squeezed point and the pump 10 is flattened due to suction created by the pump 10, causing the tapered one end 20*a* of the lever 20 to firmly engage the tube-B 11*b*. Thus, fluid communication through the tube-B 11*b* is completely blocked, and fluid communication through the tube-A 11*a* only is allowed to permit discharge of ink from the nozzles of the printhead-A 1*a* via the cap-A 7*a*.

Figure 6:
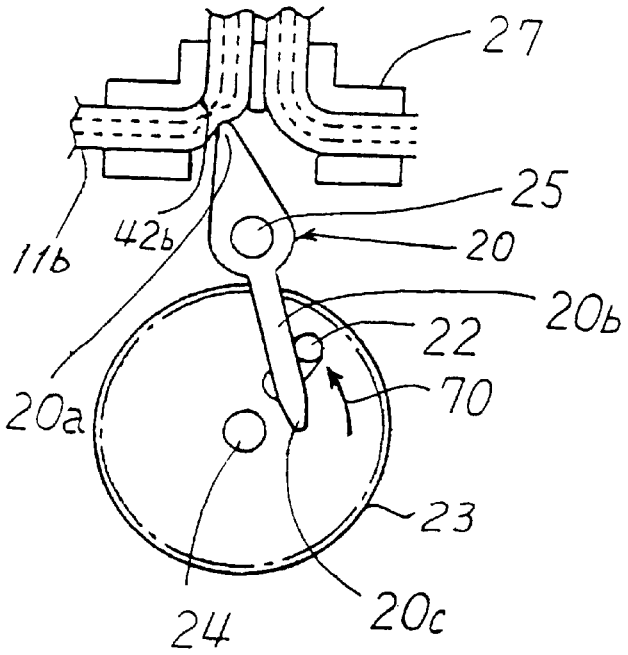
FIG. 6 is a similar view to FIG. 2, illustrating the switch valve in a transient state into a third position shown in FIG. 7.
Figure 7:
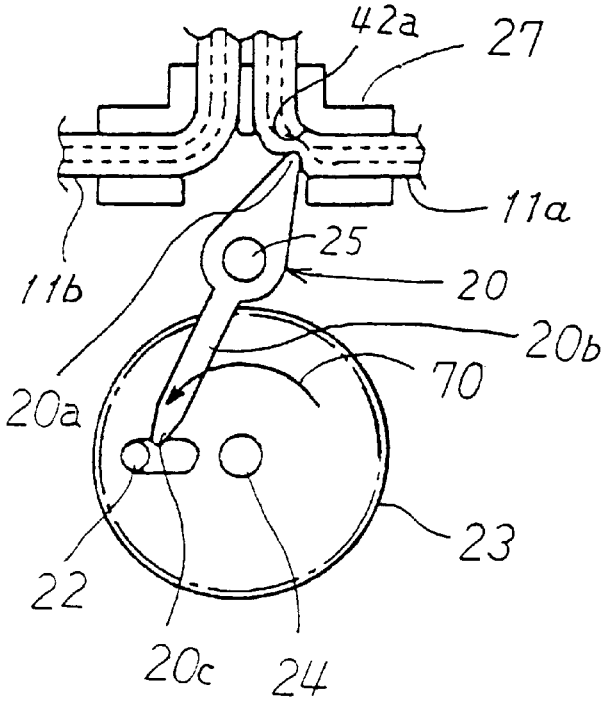
FIG. 7 is a similar view to FIG. 2, illustrating the switch valve held in the third position in which the other flexible tube is squeezed and closed.

Subsequently, the motor stops driving the pump 10 and turns the gear 23 from the position of FIG. 4 counterclockwise, viewing in FIGS. 4, 6 and 7, through approximately 180 degrees, causing the pin 22 to pivot the lever 20 clockwise. During this clockwise movement of the lever 20, the tapered end 20*a* disengages from the tube-B 11*b* and then comes into engagement with the tube-A 11*a* to squeeze the tube-A 11*a* against the corner sidewall 42*a*. After the switch valve 8 having taken the position of FIG. 7, the pump 10 resumes its operation to draw fluid. As the tube-A 11*a* is squeezed, the portion of the tube-A 11*a* that is disposed between the squeezed point and the pump 10 is flattened due to suction created by the pump 10, causing the tapered one end 20*a* of the lever 20 to firmly engage the tube-A 11*a*. Thus, fluid communication through the tube-A 11*a* is completely blocked, and fluid communication through the tube-B 11*b* only is allowed to permit discharge of ink from the nozzles of the printhead-B 1*b* via the cap-B 7*b*.

Return movement to the home position of FIG. 2 is explained. Firstly, the motor turns the gear 23 clockwise from the position of FIG. 7 through approximately 90 degrees, causing the pin 22 to pivot the lever 20 counterclockwise to the position of FIG. 2. Subsequently, the motor turns the gear 23 counterclockwise through approximately 270 degrees until the pin 22 takes the position of FIG. 2.

It is now understood that clockwise or forward rotation of the rotary member in the form of gear 23 causes counterclockwise or reverse pivotal movement of the lever 20, and counterclockwise or reverse rotation of the rotary member 23 causes clockwise or forward pivotal movement of the lever 20.

It is also understood that clockwise rotation of the gear 23 from the home position of FIG. 2 through 360 degrees results in blocking the tube-B 11*b*, and the subsequent counterclockwise rotation of the gear 23 through 180 degrees results in blocking the tube-A 11*a*. Clockwise rotation of the gear 23 through 90 degrees and the subsequent counterclockwise rotation of the gear 23 through 270 degrees effect return movement from the position of FIG. 7 to the home position of FIG. 2.

Figure 9:
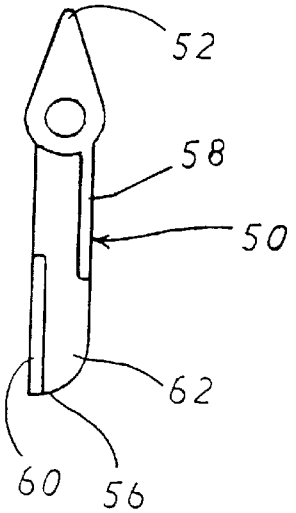
FIG. 9 is a view showing a lever of the switch valve shown in FIG. 8.

Replacing the pivot lever 20 with a new pivot lever as shown in FIG. 9 may alter the schedule of travel of the gear 23.

Referring to FIGS. 8 to 16, another form of a switch valve is explained. This valve is substantially the same as its counterpart that has been explained in connection with FIGS. 2 to 7 except the provision of the new pivotal lever 50 instead of the lever 20.

Figure 8:
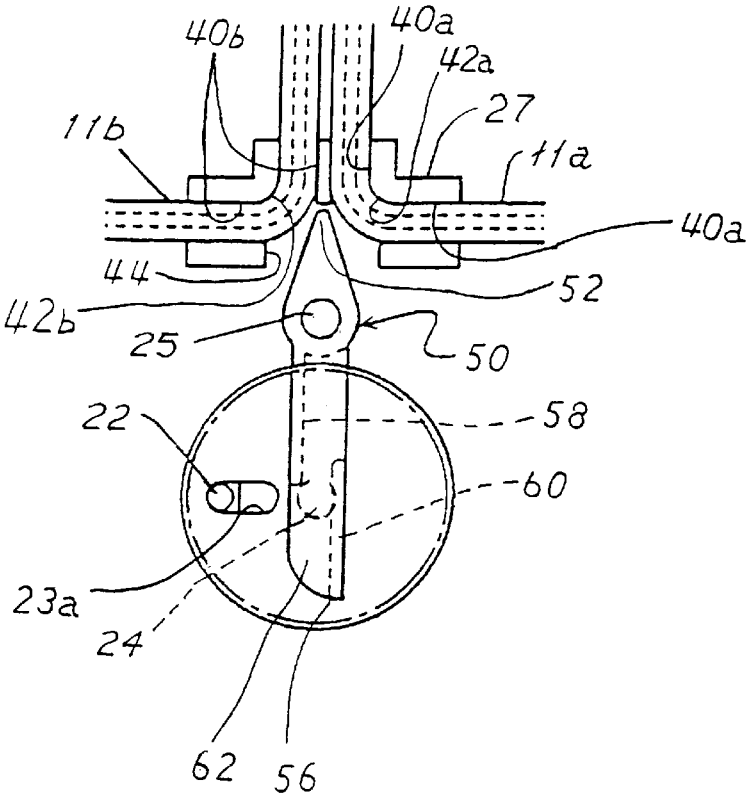
FIG. 8 is a similar view to FIG. 2, illustrating another form of a switch valve in a first or home position.

Referring to FIG. 8, at an intermediate portion, the lever 50 is mounted to a pivot shaft 25 that is provided near an entrance 44 of a tube support 27. In the same manner as the lever 20, the lever 50 extends through the entrance 44 into the recess and towards one end 52 thereof, and it is tapered towards the one end 52. The lever 50 has an arm 54 that differs from the arm 20*b* of the lever 20. The arm 54 extends towards an opposite end 56. The arm 54 includes two parallel rails, namely, a first rail 58 and a second rail 60, and an elongate flat plate 62 interconnecting the rails 58 and 60. The elongate flat plate 62 extends radially outwards from the pivot shaft 25 and terminates in at the opposite end 56. The first and second rails 58 and 60 extend along a radial direction with respect to the axis of the pivot shaft 25. These rails 58 and 60 is are disposed on the opposite sides of the radial direction and displaced in the radial direction from each other. Specifically, the first rail 58 is disposed near the pivot shaft 25 and on the trailing side, with respect to counterclockwise rotation of the lever 50, viewing in FIG. 8. The second rail 60 is disposed remote from the pivot shaft 25 and on the leading side, with respect to the counterclockwise rotation of the lever 50. The rails 58 and 60 are spaced enough to allow a pin 22 to cross the arm 54. In this embodiment, a motor that drives a pump (see FIG. 1) turns the gear 23.

The second embodiment thus far described operates as follows.

Figure 10:
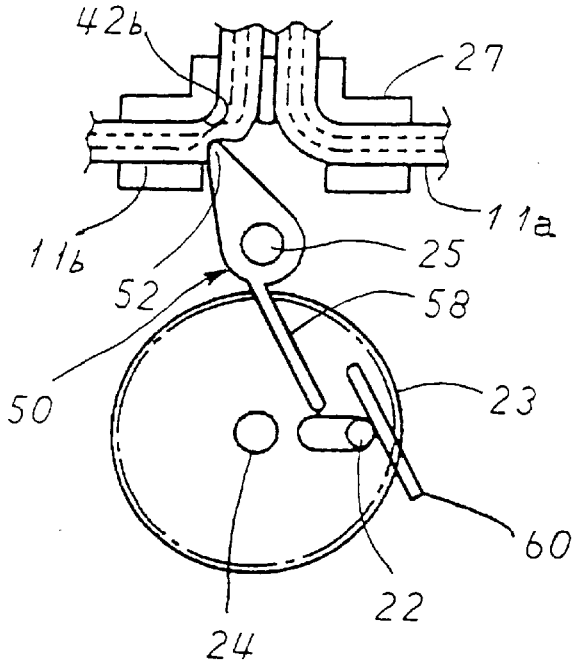
FIG. 10 is a view similar to FIG. 8, illustrating the switch valve herd in a second position in which one of flexible tubes is squeezed and closed.
Figure 11:
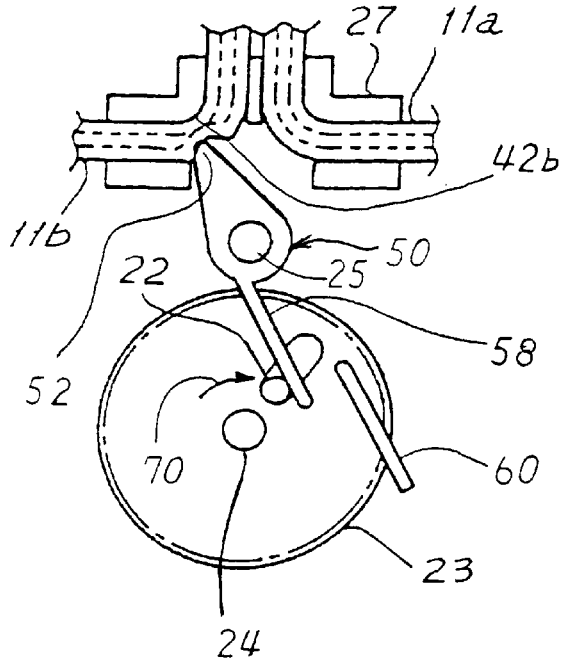
FIG. 11 is a view similar to FIG. 8, illustrating the switch valve in a transient state during a shift into the second position.

FIG. 8 illustrates a first or home position in which the lever 50 positions diametrically with respect to the axis of a gear shaft 24. Viewing in FIGS. 8, 11 and 10, turning a gear 23 by the pump driving motor clockwise from the home position brings the pin 22 into abutting engagement with the outer side of the first rail 58 of the arm 54. Further clockwise rotation of the gear 23 causes the pin 22 to pivot the lever 50 counterclockwise to the position of FIG. 10 and FIG. 11. During this counterclockwise movement of the lever 50, the tapered end 52 presses a flexible tube-B 11*b* towards a corner sidewall 42*b*. As the lever 50 stops its counterclockwise movement, clockwise rotation of the gear 23 causes the first rail 58 of the arm 54 to move the pin 22 against a spring 28 (see FIG. 3) for radial inward movement to the radial innermost position as shown in FIG. 11. The pin 22 moves along a radial slot 23*a* to clear the first rail 58 of the arm 54, thus allowing smooth rotation of the gear 23 from the position of FIG. 11 to the position of FIG. 10. In the position of FIG. 10, the tapered one end 52 cooperates with the corner sidewall 42*b* to squeeze the tube-B 11*b* and the pin 22 takes the radial outermost position again. Owing to the resiliency of the tube-B 11*b* that is interposed between the tapered one end 52 and the corner sidewall 42*b*, the lever 50 keeps on taking the position of FIG. 10. After the switch valve having taken the position of FIG. 10, the motor starts driving the pump 10 and turning the gear clockwise. This clockwise rotation of the gear 23 while the pump 10 is put into operation will not cause the pin 22 to pivot the lever 50 from the position of FIG. 10. As the tube-B 11*b* is squeezed, the portion of the tube-B 11*b* that is disposed between the squeezed point and the pump 10 is flattened due to suction created b y the pump 10, causing the tapered one end 52 of the lever 50 to firmly engage the tube-B 11*b*. Thus, fluid communication through the tube-B 11*b* is completely blocked, and fluid communication through a flexible tube-A 11*a* only is allowed to permit discharge of ink from the nozzles of a printhead-A 1*a* via a cap-A 7*a* (see FIG. 1).

Figure 12:
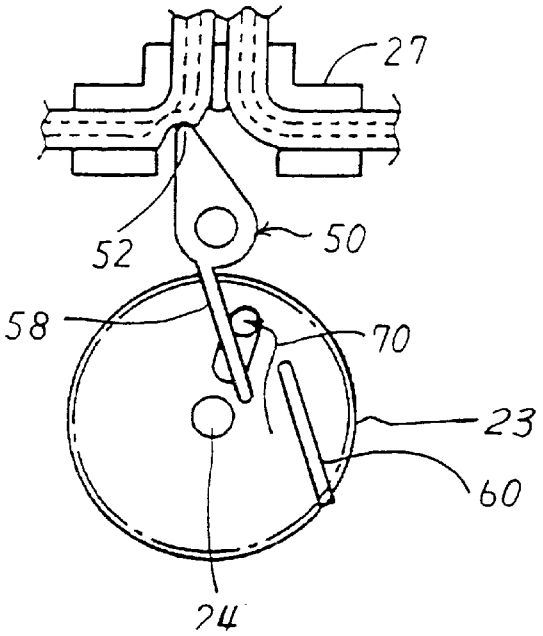
FIG. 12 is a view similar to FIG. 8, illustrating the switch valve taking a transient state immediately after the second position during a shift into a third position as illustrated in FIG. 15.
Figure 13:
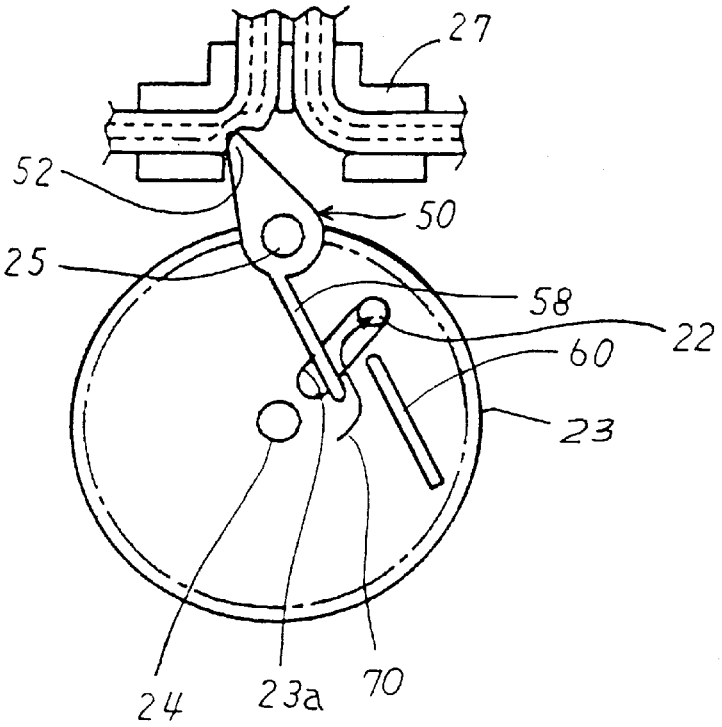
FIG. 13 is a view similar to FIG. 12, illustrating a modified modification of the switch valve.

If need arises to pivot the lever 50 from the position of FIG. 10, the motor stops driving the pump 10 and turns the gear 23 from the position of FIG. 10 counterclockwise through a predetermined angle to the position of FIG. 12. This reverse rotation through the predetermined angle is carried out to bring the pin 22 into eventual cooperation with the second rail 60. This operation may be called "switchback." If it is desired to decrease the predetermined angle of the switchback, a gear 23 with a larger diameter should be used to allow provision of a pin 22 having a longer radial travel as shown in FIG. 13. The position of FIG. 10 may be called "a first start position for switchback."

Figure 14:
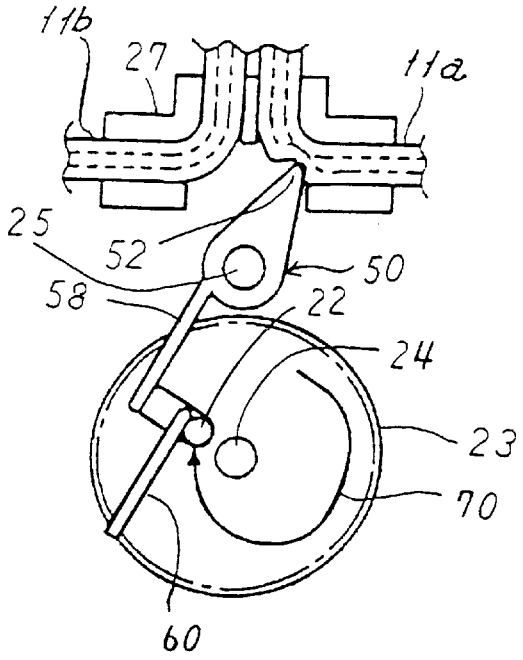
FIG. 14 is a view similar to FIG. 8, illustrating the switch valve in a transient state immediately before the third position during the shift to the third position.
Figure 15:
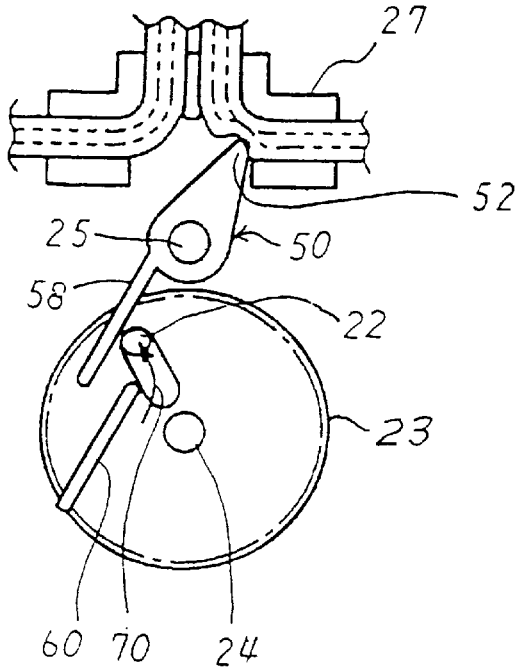
FIG. 15 is a view similar to FIG. 8, illustrating the switch valve held in the third position in which the other of the tubes is squeezed and closed.
Figure 16:
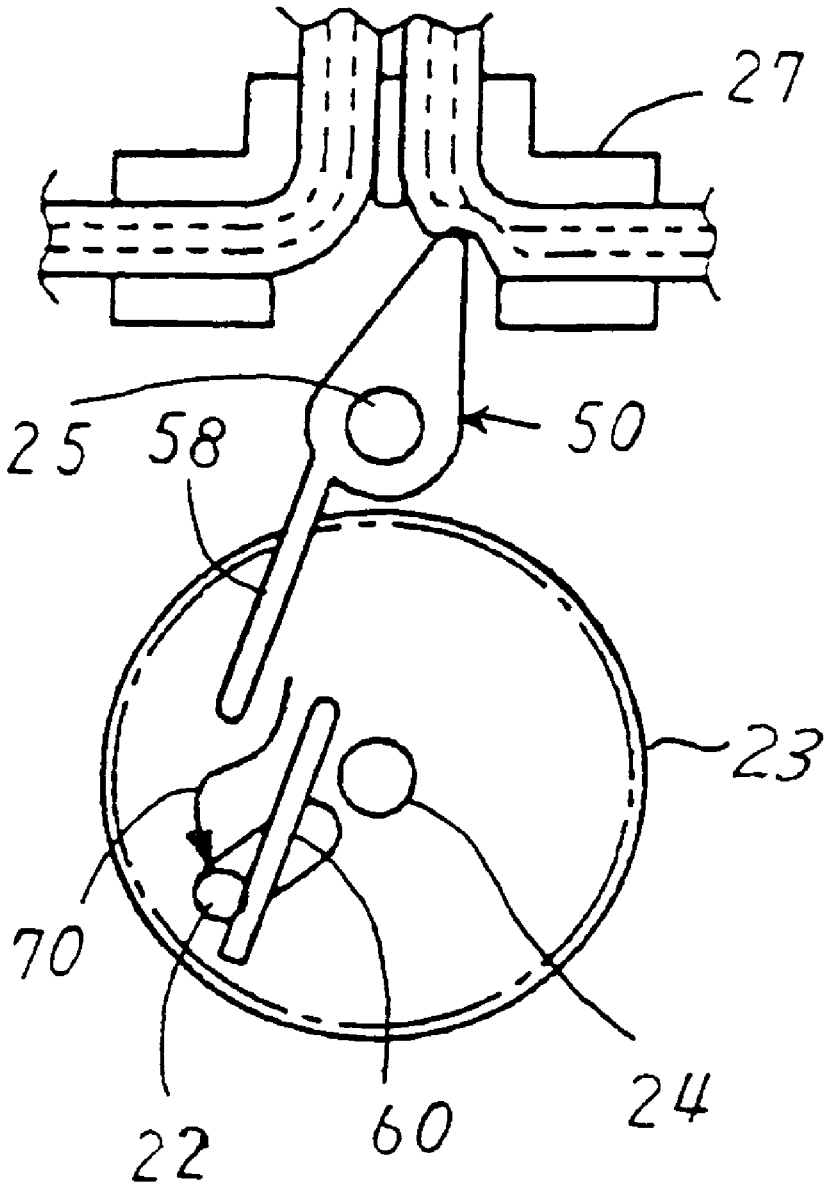
FIG. 16 is a view similar to FIG. 8, illustrating the switch valve in a transient state immediately after the second position during a shift to the home position shown in FIG. 8.

Upon completion of the switchback, the motor turns the gear 23 from the position of FIG. 12 clockwise, as viewed in FIGS. 12, 14 and 15, causing the pin 22 to engage the outer side of the second rail 60 to pivot the lever 50 clockwise. During this clockwise movement of the lever 50, the tapered end 52 disengages from the tube-B 11*b* and then comes into engagement with the tube-A 11*a* to squeeze the tube-A 11*a* against a corner sidewall 42*a*. After the switch valve having taken the position of FIG. 15, the motor starts driving the pump 10 and turning the gear 23 clockwise. This clockwise rotation of the gear 23 will cause the pin 22 to pivot the lever 50 from the position of FIG. 14. As the tube-A 11*a* is squeezed, the portion of the tube-A 11*a* that is disposed between the squeezed point and the pump 10 is flattened due to suction created by the pump 10, causing the tapered one end 52 of the lever 50 to firmly engage the tube-A 11*a*. Thus, fluid communication through the tube-A 11*a* is completely blocked, and fluid communication through the tube-B 11*b* only is allowed to permit discharge of ink from the nozzles of a printhead-B 1*b* via a cap-B 7*b* (see FIG. 1).

Reverse pivotal movement from the position of FIG. 15 to the position of FIG. 10 is explained. First, the motor turns the gear 23 counterclockwise through a predetermined angle from the position of FIG. 15 to the position of FIG. 16 to conduct switchback. As the switchback is initiated at the position of FIG. 15, the position of FIG. 15 may be called "a second start position for switchback." Upon completion of the switchback, the motor turns the gear 23 clockwise, causing the pin 22 to engage the outer side of the first rail 58 to pivot the lever 50 counterclockwise from the position of FIG. 15 to the position of FIG. 10.

Return movement to the home position of FIG. 8 from the position of FIG. 15 is explained. Firstly, the motor turns the gear 23 counterclockwise to cause the pin 22 to engage the inner side of the second rail 60 to rotate the lever 50 clockwise from the position of FIG. 15 to the position of FIG. 8. Secondly, the motor turns the gear 23 clockwise to place the pin 22 to the position of FIG. 8.

According to the second embodiment, when the lever 50 keeps on squeezing the tube-A 11*a* or the tube-B 11*b*, clockwise rotation of the gear 23 will not cause any pivotal movement of the lever 50. Counterclockwise rotation of the gear 23 through a predetermined angle from the start position for switchback as illustrated in FIG. 10 or FIG. 15 and the subsequent clockwise rotation of the gear 23 causes pivotal movement of the lever 50. Besides, the start position for kickback determines direction of pivotal movement of the lever 50 during the subsequent clockwise rotation.

In order to facilitating understanding of operation of the first and second embodiments, the path of the pin 22 is indicated by an arrow 70 in each of FIGS. 5–7, and 11–16.

What is claimed is:

1. A service station for an ink-jet printer including printheads, comprising:

caps for the printheads, respectively;

a pump;

flexible tubes connecting said caps to said pump; and a switch valve fluidly disposed between said caps and said pump, said switch valve having a first position in which only one of said flexible tubes is opened to allow discharge of fluid via said one cap by the pump and a second position in which only another one of said flexible tubes is opened to allow discharge of fluid via said other cap be said pump, wherein said switch valve further includes a pivotal lever that turns in one direction to squeeze one of said flexible tubes and turns in another direction to squeeze another one of said flexible tubes.

2. A service station as claimed in claim 1, wherein said pump is operative to draw fluid through said flexible tubes in such a direction as to bring said pivot lever into firm engagement with said flexible tube being squeezed by said pivotal lever.

3. A service station as claimed in claim 1, wherein said switch valve further includes a rotary member having an axis and mounted for rotation about said axis to cooperate with said pivot lever to control pivotal movement of said pivot lever.

4. A service station as claimed in claim 3, wherein rotation of said rotary member in a clockwise direction causes pivotal movement of said pivotal lever in a counter clockwise direction, and rotation of said rotary of said rotary member in the counter clockwise direction causes pivotal movement of said lever in the clockwise direction.

5. A service station as claimed in claim 3, wherein, when said pivotal lever closes one of said flexible tubes by squeezing, rotation of said rotary member in a clockwise direction fails to pivot said pivotal lever, but rotation of said rotary member in counter clockwise direction through a predetermined angle from a predetermined position and subsequent rotation of said rotary member in the clockwise direction causes pivotal movement of said pivotal lever.

6. A service station as claimed in claim 3, wherein said rotary member is turned by a motor that is provided for driving said pump.

7. A service station as claimed in claim 6, wherein said rotary member is a gear.

8. A service station as claimed in claim 3, wherein said rotary member has a pin that is spring biased for radial outward movement with respect to said axis of said rotary member.

9. A service station as claimed in claim 8, wherein rotation of said rotary member causes said pin to pivot said pivot lever.

10. A service station as claimed in claim 9, wherein said pivotal lever includes an arm that is engaged by said pin.

11. A service station as claimed in claim 10, wherein said switch valve includes a tube support for said flexible tubes.

12. A service station as claimed in claim 11, wherein said tube support is formed with grooves, each having a corner portion and includes wall means defining said grooves, wherein said wall means includes a first corner sidewall that partly defines the corner portion of one of said grooves, and a second corner sidewall that partly defines the corner portion of the other one of said grooves, wherein said tube support has an entrance and is recessed inwardly towards said first and second corner sidewalls from said entrance, and wherein said first and second corner sidewalls protrude towards said entrance.

13. A service station as claimed in claim 12, wherein said flexible tubes are fit in said grooves, respectively, and curved along said first and second corner sidewalls, respectively.

14. A service station as claimed in claim 13, wherein said pivotal lever extends through said entrance into the recess and toward one end thereof, and said pivotal lever is tapered towards said one end thereof.

15. A service station as claimed in claim 14, wherein said arm includes two parallel rails and an elongate plate interconnecting said two parallel rails, and said two parallel rails are disposed on the opposite sides of a radial direction with respect to the axis of said pivotal lever and displaced in said radial direction from each other.

* * * * *